US012092345B2

(12) United States Patent
Drake et al.

(10) Patent No.: US 12,092,345 B2
(45) Date of Patent: Sep. 17, 2024

(54) SYSTEMS AND METHODS FOR CONTROLLING TWINNED HEATING APPLIANCES

(71) Applicant: Rheem Manufacturing Company, Atlanta, GA (US)

(72) Inventors: Dean A. Drake, Indianapolis, IN (US); Robert Oglesbee, Fishers, IN (US); Shawn Reed, Charleston, AR (US); Rodrigo Cedeno, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 63 days.

(21) Appl. No.: 17/202,516

(22) Filed: Mar. 16, 2021

(65) Prior Publication Data

US 2022/0299213 A1 Sep. 22, 2022

(51) Int. Cl.

| | |
|---|---|
| ***F24D 19/10*** | (2006.01) |
| ***F24D 5/04*** | (2006.01) |
| ***F24D 12/00*** | (2006.01) |
| ***F24D 19/00*** | (2006.01) |
| ***F24H 9/00*** | (2022.01) |

(52) U.S. Cl.

CPC ..... *F24D 19/1084* (2013.01); *F24D 5/04* (2013.01); *F24D 12/00* (2013.01); *F24D 19/0087* (2013.01); *F24H 9/0063* (2013.01); *F24H 9/0073* (2013.01); *F24D 2200/00* (2013.01); *F24D 2220/042* (2013.01); *F24D 2220/044* (2013.01)

(58) Field of Classification Search

None

See application file for complete search history.

(56) References Cited

U.S. PATENT DOCUMENTS

| | | | | |
|---|---|---|---|---|
| 5,316,073 A * | 5/1994 | Klaus | F24F 11/63 | 236/11 |
| 5,337,952 A * | 8/1994 | Thompson | G05D 23/1917 | 236/46 E |
| 6,423,118 B1 * | 7/2002 | Becerra | B01D 46/46 | 96/417 |

(Continued)

OTHER PUBLICATIONS

PCT, "International Search Report & Written Opinion" Application No. PCT/US2022/020118, dated Jun. 23, 2022 (13 pp.).

*Primary Examiner* — Edelmira Bosques
*Assistant Examiner* — Deepak A Deean
(74) *Attorney, Agent, or Firm* — Eversheds Sutherland (US) LLP

(57) ABSTRACT

A system and a method for controlling twinned heating appliances are described. The system includes a first heating appliance and a second heating appliance. The first heating appliance includes a first blower and a first wireless communication unit. Further, the second heating appliance is operatively coupled with the first heating appliance as a twinned unit. The second heating appliance includes a second blower and a second wireless communication unit. The system also includes a primary control unit configured to receive speed data indicative of a speed of the first blower and speed data indicative of a speed of the second blower. The primary control unit is further configured to output a blower speed control signal to at least one of the first blower and the second blower to synchronize the first blower and the second blower.

18 Claims, 4 Drawing Sheets

(56) References Cited

U.S. PATENT DOCUMENTS 7,377,120 B2 * 5/2008 Zikes ..... F24F 11/30 62/175
8,091,373 B2 * 1/2012 Hugghins ..... F24F 11/52 62/127
8,352,080 B2 * 1/2013 Grohman ..... F24F 11/64 709/249
8,352,081 B2 * 1/2013 Grohman ..... H04L 67/51 700/276
8,452,906 B2 * 5/2013 Grohman ..... F24F 11/62 710/105
8,560,125 B2 * 10/2013 Wallaert ..... G05B 15/02 700/276
8,564,400 B2 * 10/2013 Grohman ..... G05B 19/042 714/4.11
8,774,210 B2 * 7/2014 Grohman ..... H04L 12/413 370/448
8,874,815 B2 * 10/2014 Grohman ..... G05B 15/02 710/105
8,892,797 B2 * 11/2014 Grohman ..... H04L 12/407 710/104
8,977,794 B2 * 3/2015 Grohman ..... G05B 15/02 710/104
10,619,880 B2 * 4/2020 Ritmanich ..... F24F 3/044
11,466,887 B2 * 10/2022 Ritmanich ..... G05D 23/1904
2003/0041605 A1 * 3/2003 Butcher ..... F24F 11/88 62/175
2004/0217182 A1 * 11/2004 St. Jean ..... F23Q 7/24 237/2 A
2004/0230402 A1 * 11/2004 St. Jean ..... F23Q 7/24 702/189
2007/0068179 A1 * 3/2007 Zikes ..... F24F 11/30 62/157
2009/0044552 A1 * 2/2009 Hugghins ..... F24F 11/77 62/175
2010/0106313 A1 * 4/2010 Grohman ..... H04L 12/2803 700/276
2010/0106320 A1 * 4/2010 Grohman ..... G05B 19/0428 710/316
2010/0106322 A1 * 4/2010 Grohman ..... H04L 12/66 709/206
2010/0106323 A1 * 4/2010 Wallaert ..... G05B 15/02 715/771
2010/0106324 A1 * 4/2010 Grohman ..... H04L 12/407 709/221
2010/0106325 A1 * 4/2010 Grohman ..... H04L 67/51 709/206
2010/0106326 A1 * 4/2010 Grohman ..... H04L 67/125 709/220
2010/0106327 A1 * 4/2010 Grohman ..... F24F 11/38 719/315
2010/0106787 A1 * 4/2010 Grohman ..... G05B 15/02 709/206
2010/0106810 A1 * 4/2010 Grohman ..... B60H 1/00978 700/277
2010/0107232 A1 * 4/2010 Grohman ..... G05B 19/4185 711/E12.091
2010/0115364 A1 * 5/2010 Grohman ..... H04L 12/413 714/748
2013/0173064 A1 * 7/2013 Fadell ..... F24F 11/70 700/276
2013/0338839 A1 * 12/2013 Rogers ..... F24F 11/57 700/278
2014/0052300 A1 * 2/2014 Matsuoka ..... F24F 11/46 700/276
2019/0109907 A1 * 4/2019 Duraisingh ..... H04L 41/12
2019/0331358 A1 * 10/2019 Ritmanich ..... F24F 11/54
2020/0149780 A1 5/2020 Chase
2020/0232670 A1 * 7/2020 Ritmanich ..... F24F 3/044

* cited by examiner

SYSTEMS AND METHODS FOR CONTROLLING TWINNED HEATING APPLIANCES

TECHNICAL FIELD

The present disclosure relates, in general, to controlling heating appliances, and more specifically relates, to controlling heating appliances that are operatively coupled as a twinned unit.

BACKGROUND

Typically, a large enclosed space, such as a residential building or a commercial building requires more heating than can be provided by a single heating appliance. In such situations, capacity requirements for heating the large enclosed space require more than one heating appliance. Currently, the capacity requirements are met by having two identical heating appliances "twinned" such that the two heating appliances operate in tandem. The twinned heating appliances need to be of a same model, capacity, require same power operating at a same phase, have heating and blower capacity with identical motors and control boards. Twinning typically involves the heating appliance to be installed side-by-side and operated in twinned mode to circulate air through a common supply and return supply duct system and controlled by a common thermostat. Such installation effectively increases the amount of heat that can be distributed into the enclosed space. Typically, each heating appliance includes a blower that circulates the air to the enclosed space through the common duct. Typically, when heating appliances are twinned, blowers of both heating appliances are configured to run simultaneously when there is a call for heating or cooling. In some cases, in the twinned heating appliances, blowers of the heating appliances may not operate at the same speed; in such cases, one of the blowers may try to satisfy all the demand. As a consequence, a disproportionate fraction of air may be circulated by the heating appliances. i.e., one heating appliance may circulate substantially higher or lower amount of air than the other heating appliance. This may lead to an airflow imbalance situation and may create a burden on one heating appliance in comparison to the other heating appliance. Accordingly, one of the heating appliances may overheat, resulting in damage to the heating appliance.

SUMMARY

According to an aspect of the present disclosure, a system for controlling twinned heating appliances is disclosed. The system includes a first heating appliance and a second heating appliance. The first heating appliance includes a first blower and a first wireless communication unit. The second heating appliance is operatively coupled with the first heating appliance as a twinned unit. The second heating appliance includes a second blower and a second wireless communication unit. The system also includes a primary control unit configured to receive speed data indicative of a speed of the first blower and speed data indicative of a speed of the second blower. The primary control unit is further configured to output a blower speed control signal to at least one of the first blower and the second blower to synchronize the first blower and the second blower.

In an embodiment, the primary control unit is integrated into one of the first heating appliance and the second heating appliance. In an embodiment, the system further includes a secondary control unit. The secondary control unit and the primary control unit are configured to operate together in a primary/secondary configuration.

In an embodiment, the primary control unit is further configured to obtain the speed data associated with the first blower of the first heating appliance through the first wireless communication unit and the speed data associated with the second blower of the second heating appliance through the second wireless communication unit, compare the speed data associated with the first blower of the first heating appliance with the speed data associated with the second blower of the second heating appliance, generate the blower speed control signal for synchronizing the speed of the first blower of the first heating appliance and the speed of the second blower of the second heating appliance, and output the blower speed control signal to at least one of the first blower and the second blower through the first wireless communication unit and the second wireless communication unit, respectively, to synchronize the first blower and the second blower.

In an embodiment, the primary control unit is configured to output the blower speed control signal to the at least one of the first blower and the second blower to either maintain the speed of the at least one of the first blower and the second blower or modify the speed of the at least one of the first blower and the second blower. In an embodiment, each of the first wireless communication unit and the second wireless communication unit includes a Bluetooth module.

In an embodiment, the first blower of the first heating appliance and the second blower of the second heating appliance include a first motor and a second motor, respectively. Each of the first motor and the second motor is an electronically commutated or brushless DC motor. In an embodiment, the system further includes a common supply duct coupled with the first heating appliance and the second heating appliance. The first blower and the second blower are configured to circulate air to an enclosed space through the common supply duct.

According to another aspect of the present disclosure, a method for controlling heating appliances including a first heating appliance and a second heating appliance twinned together is disclosed. The method includes receiving, by a primary control unit, data indicative of a speed of a first blower of the first heating appliance through a first wireless communication unit of the first heating appliance, receiving, by the primary control unit, data indicative of a speed of a second blower of the second heating appliance through a second wireless communication unit of the second heating appliance, generating, by the primary control unit, a blower speed control signal to synchronize the speed of the first blower with the speed of the second blower, communicating, by the primary control unit, the blower speed control signal to at least one of the first heating appliance and the second heating appliance through the first wireless communication unit and the second wireless communication unit, respectively, and synchronizing, by the primary control unit, the speed of the first blower and the speed of the second blower based on the blower speed control signal. In an embodiment, the primary control unit is a part of one of the first heating appliance and the second heating appliance.

In an embodiment, the method further includes comparing, by the primary control unit, the speed of the first blower of the first heating appliance with the speed of the second blower of the second heating appliance, and responsive to determining the speed of the first blower to be different from the speed of the second blower and generating, by the primary control unit, the blower speed control signal for synchronizing the speed of the first blower and the speed of the second blower.

In an embodiment, the method further includes receiving, by the first heating appliance through the first wireless communication unit, the blower speed control signal from the primary control unit and modifying, by the first heating appliance, the speed of the first blower to synchronize the speed of the first blower with the speed of the second blower.

In an embodiment, the method further includes receiving, by the second heating appliance through the second wireless communication unit, the blower speed control signal from the primary control unit and modifying, by the second heating appliance, the speed of the second blower to synchronize the speed of the second blower with the speed of the first blower. In an embodiment, each of the first wireless communication unit and the second wireless communication unit includes a Bluetooth module.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1A:
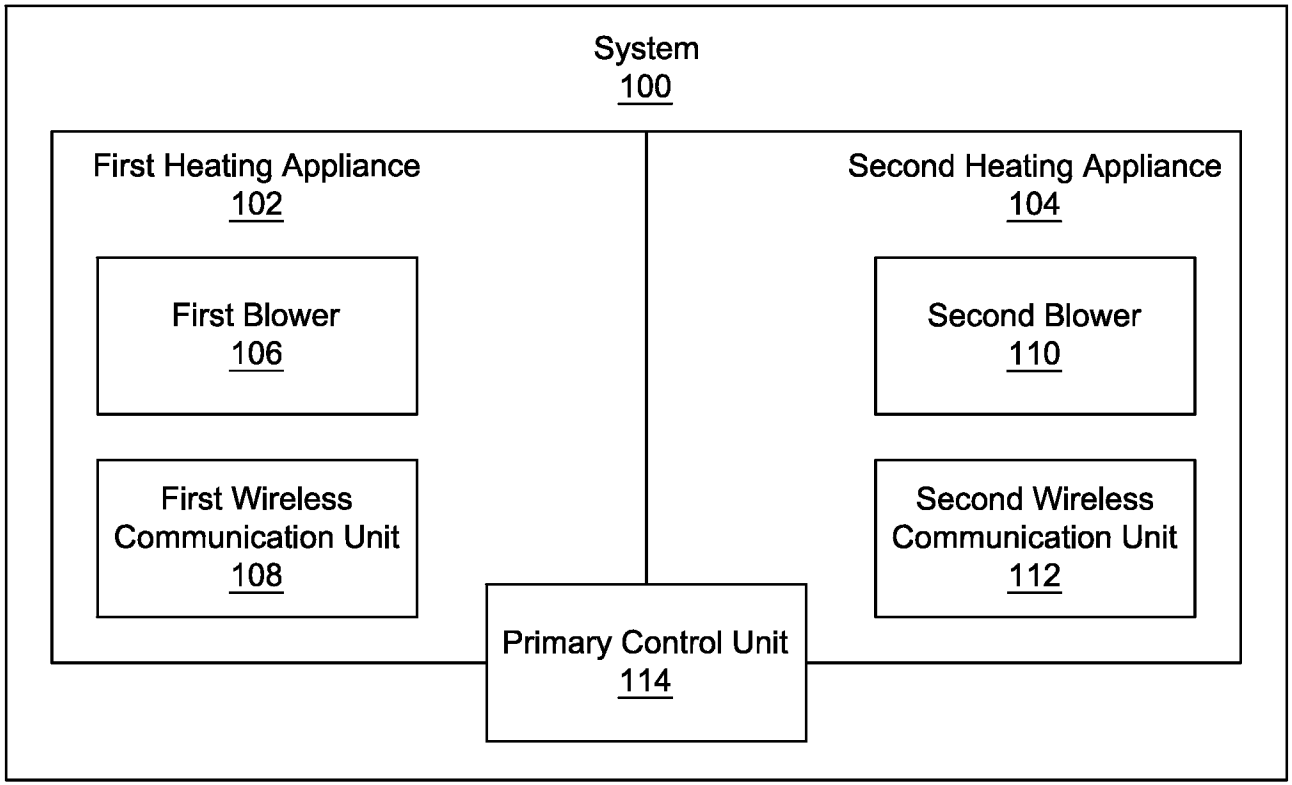
FIG. 1A is a block diagram illustrating a system for controlling twinned heating appliances.

FIG. 1A is a block diagram illustrating a system 100 for controlling twinned heating appliances. In an embodiment, the system 100 may be a centralized heating system that may be used for heating enclosed spaces such as residential and commercial buildings. The system 100 may facilitate in controlling two or more heating appliances that are operatively coupled as a twinned unit, where each heating appliance is adapted to circulate air to an enclosed space through a common supply duct. Examples of a heating appliance include but are not limited to a furnace, a boiler, and/or heaters. In an example, a common supply duct may be a duct that delivers air from a heating appliance into an enclosed space. Accordingly, the air is forced through the heating appliances into the common supply duct and then to the enclosed space. Also, the air is returned to the heating appliances through a common return duct. A common return duct may be a duct that draws air out of an enclosed space and deliver to a heating appliance. Although it has been described that the system 100 is used for heating operation for the enclosed spaces, in an embodiment, the system 100 may be used for both heating and cooling operations for the enclosed spaces, heating operation only, or cooling operation only.

In an embodiment, the system 100 may include a first heating appliance 102 and a second heating appliance 104. In an example, the first heating appliance 102 and the second heating appliance 104 may be furnaces having control boards (not shown or explained for the sake of brevity) that are used for controlling the operation of the first heating appliance 102 and the second heating appliance 104. In an example, the first heating appliance 102 and the second heating appliance 104 may be installed side-by-side in close proximity to each other. The system 100 may also include a common supply duct and a common return duct (both not shown in FIG. 1A). In an implementation, the first heating appliance 102 may be operatively coupled with the second heating appliance 104 as a twinned unit where each of the first heating appliance 102 and the second heating appliance 104 is adapted to circulate air to an enclosed space through the common supply duct and the air is returned from the enclosed space to the first heating appliance 102 and the second heating appliance 104 through the common return duct.

Referring again to FIG. 1A, the first heating appliance 102 may include a first blower 106 and a first wireless communication unit 108. In an embodiment, the first blower 106 may include a first motor (not shown in FIG. 1A) for driving the first blower 106. In an example, the first motor may be an electronically commutated motor or brushless DC motor. Other examples of motors for the first motor are contemplated herein. In an implementation, the first blower 106 may deliver air to the enclosed space through the common supply duct. In an example, the airflow rates may be represented in cubic feet per minute (CFM). In an embodiment, the first wireless communication unit 108 may facilitate communication between the first heating appliance 102 and the second heating appliance 104, and other components of the system 100. In an example, the first wireless communication unit 108 may include a Bluetooth module or any other wireless communication interface. In some embodiments, the first heating appliance 102 may include a wired communication unit (not shown). In an example, the wired unit may be EcoNet™ or any other wired communication interface. In some other embodiments, the first wireless communication unit 108 may include a combination of a wireless unit and a wired unit.

Referring again to FIG. 1A, the second heating appliance 104 may include a second blower 110 and a second wireless communication unit 112. In an embodiment, the second blower 110 may include a second motor (not shown in FIG. 1A) for driving the second blower 110. In an example, the second motor may be an electronically commutated motor or brushless DC motor. Other motors that can be used for the second motor are contemplated herein. In an implementation, the second blower 110 may deliver air to the enclosed space through the common supply duct. In an implementation, each of the first blower 106 and the second blower 110 may be a variable speed blower i.e., they can modulate their speed independently.

In an embodiment, the second wireless communication unit 112 may facilitate communication between the first heating appliance 102 and the second heating appliance 104, and other components of the system 100. In an example, the second wireless communication unit 112 may include a Bluetooth module or any other wireless communication interface. In some embodiments, the second heating appliance 104 may include a wired communication unit. In an example, the wired unit may be EcoNet™ or any other wired communication interface. In some other embodiments, the second wireless communication unit 112 may include a combination of a wireless unit and a wired unit. In an implementation, the first wireless communication unit 108 and the second wireless communication unit 112 may communicate with each other for data exchange.

In an implementation, the system 100 may be configured to monitor its components through control boards to ensure that the components are operating as desired. In an implementation, the first wireless communication unit 108 and the second wireless communication unit 112 may be used for communications between the control boards (of for example, the first heating appliance 102 and the second heating appliance 104) and an Electric Expansion Valve Control (EXV) control, and/or between other components of the system 100.

Figure 1B:
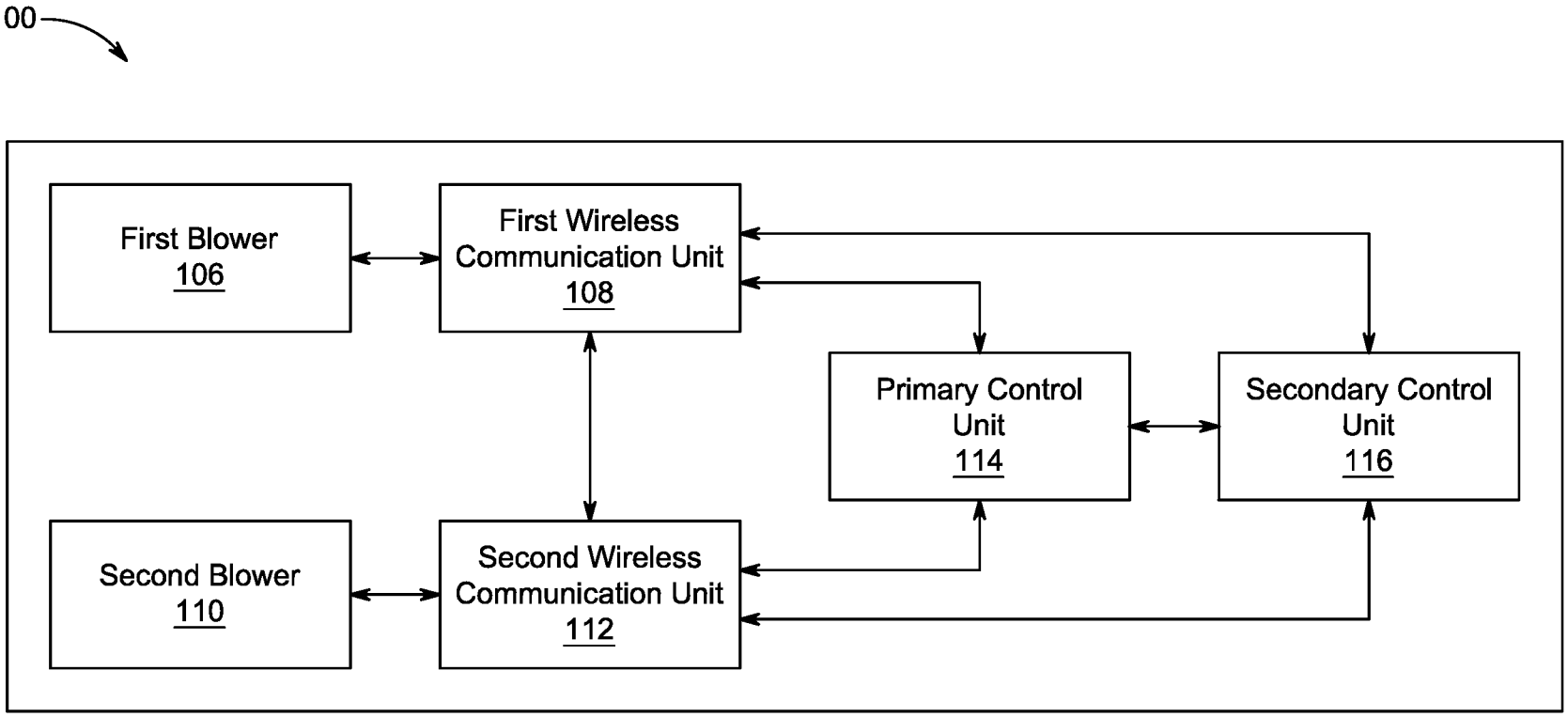
FIG. 1B is another block diagram illustrating an operation of the system.

In an embodiment, the system 100 further includes a primary control unit 114. According to an embodiment, the system 100 may also include a secondary control unit 116 as shown in FIG. 1B. In an example, each of the primary control unit 114 and the secondary control unit 116 may be a processor, a controller, a logic circuit, and/or any device that is configured to control the operations of the first heating appliance 102 and the second heating appliance 104. In an implementation the primary control unit 114 and the secondary control unit 116 may be configured to continuously monitor and control operations of the first heating appliance 102 and the second heating appliance 104.

In an implementation, the primary control unit 114 and the secondary control unit 116 may be configured to operate together in a primary/secondary configuration. According to an implementation, the primary control unit 114 may be configured to act as a primary unit and the secondary control unit 116 may be configured to act as a secondary unit under control of the primary unit. In some implementations, the secondary control unit 116 may be configured to act as a primary unit and the primary control unit 114 may be configured to act as a secondary unit. In an implementation, the primary control unit 114 and the secondary control unit 116 may be interconnected and may be time synchronized. Further, in an implementation, the primary control unit 114 and the secondary control unit 116 may communicate with each other through the first wireless communication unit 108 and the second wireless communication unit 112. Therefore, in combination, the primary control unit 114 and the secondary control unit 116 may monitor and control the operations of the first heating appliance 102 and the second heating appliance 104.

In an example embodiment, the primary control unit 114 may be integrated into one of the first heating appliance 102 and the second heating appliance 104. Similarly, the secondary control unit 116 may be integrated into one of the first heating appliance 102 and the second heating appliance 104. In an example, the primary control unit 114 may be integrated into the first heating appliance 102 and the secondary control unit 116 may be integrated into the second heating appliance 104, or vice versa. In one embodiment, the primary control unit 114 and the secondary control unit 116 may be external to the first heating appliance 102 and the second heating appliance 104.

In an implementation, the first heating appliance 102 (or any component therein, such as the first blower 106) and the second heating appliance 104 (or any component therein, such as the second blower 110) may communicate with either or both of the primary control unit 114 and the secondary control unit 116 through the first wireless communication unit 108 and the second wireless communication unit 112, respectively. In some implementations, the primary control unit 114 may be a part of the first heating appliance 102. Accordingly, the primary control unit 114 may communicate with the first heating appliance 102 directly. In some implementations, the secondary control unit 116 may be a part of the second heating appliance 104. Accordingly, the secondary control unit 116 may communicate with the second heating appliance 104 directly.

In operation, the primary control unit 114 may continuously or periodically monitor the first heating appliance 102 and the second heating appliance 104. In an example, the primary control unit 114 may monitor the first heating appliance 102 and the second heating appliance 104 in order of minutes, seconds, or some other time period. In an implementation, the primary control unit 114 may requests for various types of data from the first heating appliance 102 and the second heating appliance 104 in order to monitor and control the first heating appliance 102 and the second heating appliance 104.

According to an implementation, the primary control unit 114 may send a request for speed data indicative of a speed of the first blower 106 to the first heating appliance 102. In an implementation, the primary control unit 114 may send the request to the first heating appliance 102 through the first wireless communication unit 108 of the first heating appliance 102. In an example, the primary control unit 114 may communicate a first blower speed request signal requesting the speed data of the first blower 106 to the first heating appliance 102. In a similar manner, the primary control unit 114 may also send a request for speed data indicative of a speed of the second blower 106 to the second heating appliance 104 through the second wireless communication unit 112. In an example, the primary control unit 114 may communicate a second blower speed request signal requesting the speed data of the second blower 110 to the second heating appliance 104. In an example, the speed of the first blower 106 may be indicative of an amount of air delivered by the first blower 106, and the speed of the second blower 110 may be indicative of an amount of air delivered by the second blower 110.

Responsive to the first blower speed request signal and the second blower speed request signal, the first blower 106 and the second blower 110 may communicate the first blower speed and the second blower speed, respectively. In some example implementations, the first blower 106 and the second blower 110 may include a sensor to measure the first blower speed and the second blower speed in the first blower 106 and the second blower 110, respectively. The primary control unit 114 may be configured to receive the speed data indicative of the speed of the first blower 106 and the speed data indicative of the speed of the second blower 110. In an implementation, the primary control unit 114 may obtain information about the speed at which the first blower 106 is operating at time "X" through the first wireless communication unit 108 and the information about the speed at which the second blower 110 is operating at time "X" through the second wireless communication unit 112. In some implementations, the primary control unit 114 may also obtain other data from the first heating appliance 102 and the second heating appliance 104 in order to monitor and control the operations of the first heating appliance 102 and the second heating appliance 104. In an example, the other data may include air flow rate, rpm of motor, current drawn, and other such data.

In some embodiments, the primary control unit 114 may compare the speed data associated with the first blower 106 of the first heating appliance 102 with the speed data associated with the second blower 110 of the second heating appliance 104. In an implementation, if it is determined that the speed of the first blower 106 and the speed of the second blower 110 are not the same, the primary control unit 114 may generate a blower speed control signal for synchronizing the speed of the first blower 106 of the first heating appliance 102 and the speed of the second blower 110 of the second heating appliance 104. If the speeds of the first blower 106 and the second blower 110 are different, then it may be inferred that the first blower 106 and the second blower 110 deliver different amounts of air which may lead to an airflow imbalance situation.

The primary control unit 114 may output the blower speed control signal to at least one of the first blower 106 and the second blower 110 to synchronize the speed of the first blower 106 and the speed of the second blower 110. By synchronizing the speed of the first blower 106 and the speed of the second blower 110, the first blower 106 and the second blower 110 are set to operate or run at a same speed at a same time such that the first blower 106 and the second blower 110 deliver same or equal amounts of air at the same time. In some implementations, the primary control unit 114 may provide the blower speed control signal to the secondary control unit 116 for communicating to the first blower 106 and the second blower 110. Upon receiving the speed data of the first blower 106 and the second blower 110, the primary control unit 114 may send the speed data of the first blower 106 and the second blower 110 to the secondary control unit 116 for further processing, for example, for generation and communication of the blower speed control signal to the first blower 106 and the second blower 110.

In an implementation, the primary control unit 114 may output the blower speed control signal to the at least one of the first blower 106 and the second blower 110 to either maintain the speed of the at least one of the first blower 106 and the second blower 110 or modify the speed of the at least one of the first blower 106 and the second blower 110. In an implementation, the primary control unit 114 may output the blower speed control signal to the at least one of the first blower 106 and the second blower 110 through the first wireless communication unit 108 and the second wireless communication unit 112, respectively. In one scenario, if the speed of the first blower 106 is lower than the speed of the second blower 110, then the primary control unit 114 may output the blower speed control signal to the first blower 106 to increase the speed of the first blower 106 to synchronize with the speed of the second blower 110. In another example, if the speed of the second blower 110 is lower than the speed of the first blower 106, then the primary control unit 114 may output the blower speed control signal to the second blower 110 to increase the speed of the second blower 110 to synchronize the speed of the second blower 110 with the speed of the first blower 106. In another scenario, in an example, if the speed of the first blower 106 is higher than the speed of the second blower 110, then the primary control unit 114 may output the blower speed control signal to the first blower 106 to decrease the speed of the first blower 106 to synchronize with the speed of the second blower 110. In another example, if the speed of the second blower 110 is higher than the speed of the first blower 106, then the primary control unit 114 may output the blower speed control signal to the second blower 110, decrease the speed of the second blower 110 to synchronize the speed of the second blower 110 with the speed of the first blower 106. In some scenarios, irrespective of whether the speed of the first blower 106 is higher or lower than the second blower 110, or vice versa, the primary control unit 114 may output the blower speed control signal to both the first blower 106 and the second blower 110 to increase or decrease the speed of the first blower 106 and the second blower 110 to operate at same or synchronized speed. Techniques of increasing or decreasing blower speeds are known and thus are not explained in detail for the sake of brevity.

In an implementation, the primary control unit 114 may be configured to set the speed of the first blower 106 and the second blower 110 with a predetermined set speed. The predetermined set speed may define a speed at which both the first blower 106 and the second blower 110 are defined to be operated. In an implementation, if the primary control unit 114 determines that the speed of both the first blower 106 and/or the second blower 110 is below or above the predetermined threshold speed, then the primary control unit 114 may output the blower speed control signal to the first blower 106 and/or the second blower 110 to increase or decrease the speed to arrive at the predetermined set speed.

According to an implementation, at least one of the first heating appliance 102 (or the first blower 106) and the second heating appliance 104 (or the second blower 110) may be configured to receive the blower speed control signal from the primary control unit 114 through the first wireless communication unit 108 and the second wireless communication unit 112, respectively. In an example, upon receiving the blower speed control signal, the first blower 106 may either maintain its speed or modify its speed based on the speed of the second blower 110 and/or the predetermined threshold speed. In an example, if the speed of the first blower is 15000 rpm and the speed of the second blower 110 is 17000 rpm, then the first blower 106 may increase its speed by 2000 rpm, such that the speed of the first blower 106 becomes 17000 rpm, i.e., same as the speed of the second blower 110. In another example, if the speed of the first blower 106 is 20000 rpm and the speed of the second blower 110 is 17000 rpm, then upon receiving the blower speed control signal, the first blower 106 may decrease its speed by 3000 rpm, such that speed of the first blower 106 becomes 17000 rpm, i.e., same as the speed of the second blower 110. In yet another example, if the speed of the first blower 106 is 8000 rpm and the predetermined set speed is 10000 rpm, then the first blower 106 may increase its speed by 2000 rpm, such that speed of the first blower 106 becomes 10000 rpm, i.e., equal to the predetermined set speed. In yet another example, upon receiving the blower speed control signal, the first blower 106 may maintain its speed, and does not perform any action.

In an example, upon receiving the blower speed control signal, the second blower 110 may either maintain its speed or modify its speed based on the speed of the first blower 106. In an example, if the speed of the second blower 110 is 15000 rpm and the speed of the first blower 106 is 17000 rpm, then the second blower 110 may increase its speed by 2000 rpm, such that speed of the second blower 110 becomes 17000 rpm, i.e., same as the speed of the first blower 106. In another example, if the speed of the second blower 110 is 20000 rpm and the speed of the first blower 106 is 17000 rpm, then upon receiving the blower speed control signal, the second blower 110 may decrease its speed by 3000 rpm, such that speed of the second blower 110 becomes 17000 rpm, i.e., same as the speed of the first blower 106. In yet another example, if the speed of the second blower 110 is 9000 rpm and the predetermined threshold speed is 10000 rpm, then the second blower 110 may increase its speed by 1000 rpm, such that speed of the second blower 110 becomes 10000 rpm, i.e., equal to the predetermined threshold speed. In yet another example, upon receiving the blower speed control signal, the second blower 110 may maintain its speed, and does not perform any action. Accordingly, speeds of the first blower 106 and the second blower 110 are synchronized such that they deliver the same amounts of air in the enclosed space, thus ensuring that the system 100 functions properly and efficiently.

According to some embodiments, the first heating appliance 102 and the second heating appliance 104 may be remotely monitored and controlled by a computing device, such as a smartphone using the internet. In an example, the computing device may be used as a dedicated remote control for monitoring and controlling the first heating appliance 102 and the second heating appliance 104 remotely.

Figure 2B:
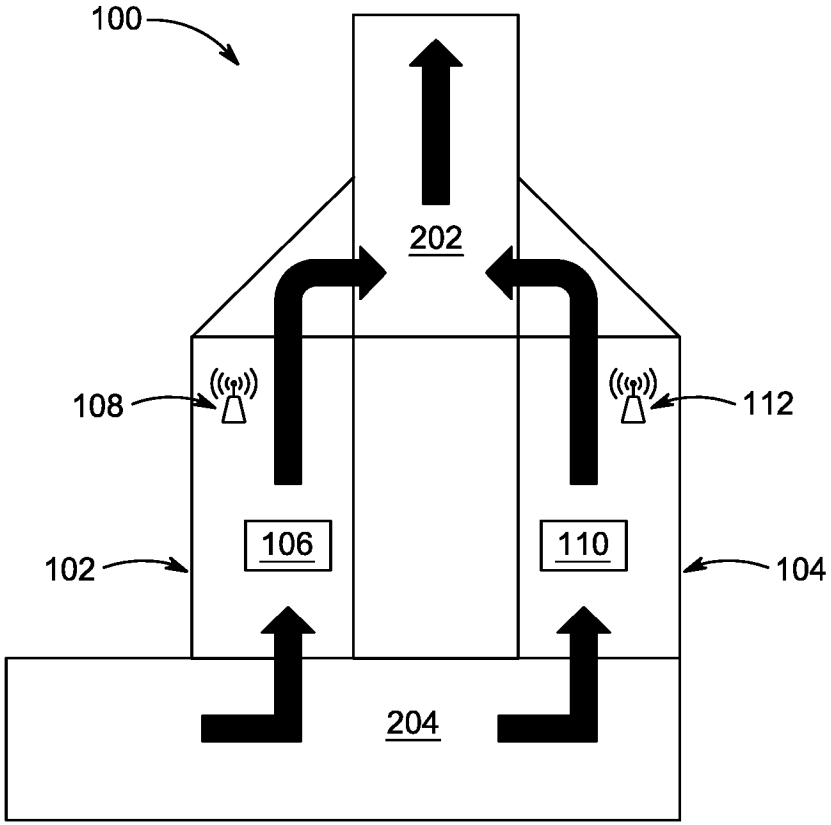
FIG. 2B is a schematic diagram of the system including the first heating appliance and the second heating appliance twinned together and synchronized to operate at same speeds.
Figure 2A:
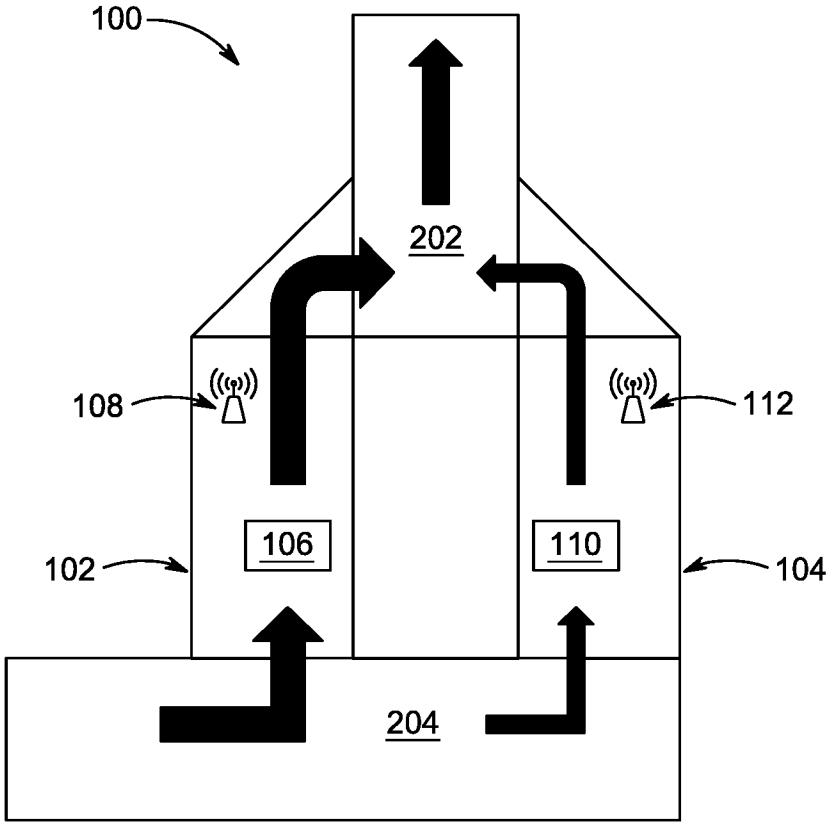
FIG. 2A is a schematic diagram of the system including a first heating appliance and a second heating appliance twinned together.

FIG. 2A is a schematic diagram of the system 100 including the first heating appliance 102 and the second heating appliance 104 twinned together.

As can be seen in FIG. 2A, the system 100 includes the first heating appliance 102 and the second heating appliance 104. Further, the first heating appliance 102 includes the first blower 106 and the first wireless communication unit 106, and the second heating appliance 104 includes the second blower 110 and the second wireless communication unit 112.

The system 100 also includes a common supply duct 202 and a common return duct 204. In an example, the common supply duct 202 may be a duct that delivers air from the first heating appliance 102 and the second heating appliance 104 into an enclosed space. Further, in an example, the common return duct 204 may be a duct that draws air out of the enclosed space and deliver to the first heating appliance 102 and the second heating appliance 104. In an implementation, the first blower 106 and the second blower 110 may be variable speed blowers, i.e., they can modulate their speed independently. In some instances, the first blower 106 and the second blower 110 may not operate at a same speed and thus likely deliver different amounts of air. In an example, the first blower 106 and the second blower 110 may operate at different speeds because of various reasons including duct design, aging of blower, etc. As shown in FIG. 2A, disproportionate fraction of air is delivered by the first heating appliance 102 and the second heating appliance 104 to the enclosed space. The flow path of air is generally in accordance with the arrows indicated in FIG. 2A. The second blower 110 circulates or delivers a lower amount of air to the enclosed space through the common supply duct 202 in comparison to the first blower 106. Also, the lower amount of air is drawn out of the enclosed space by the common return duct 204 and delivered to the second heating appliance 104 compared to the first heating appliance 102. Since different amounts of air are delivered by the first blower 106 and the second blower 110, an airflow imbalance situation may occur. This may also create a burden on the first heating appliance 102 and may hamper its operation.

FIG. 2B is a schematic diagram of the system 100 including the first heating appliance 102 and the second heating appliance 104 twinned together and synchronized to operate at same speeds.

In an implementation, the speed of the first blower 106 of the first heating appliance 102 and the speed of the second blower 110 of the second heating appliance 104 are synchronized such that they deliver the same amounts of air to the enclosed space. As described earlier, the primary control unit 114 may generate one or more blower speed control signals for synchronizing the speeds of the first blower 106 and the second blower 110. As shown in FIG. 2B, the first blower 106 and the second blower 110 circulate or deliver substantially the same amounts of air to the enclosed space through the common supply duct 202. The flow path of air is generally in accordance with the arrows indicated in FIG. 2B. Further, substantially the same amounts of air are drawn by the common return duct 204 out of the enclosed space and delivered to the first heating appliance 102 and the second heating appliance 104.

Figure 3:
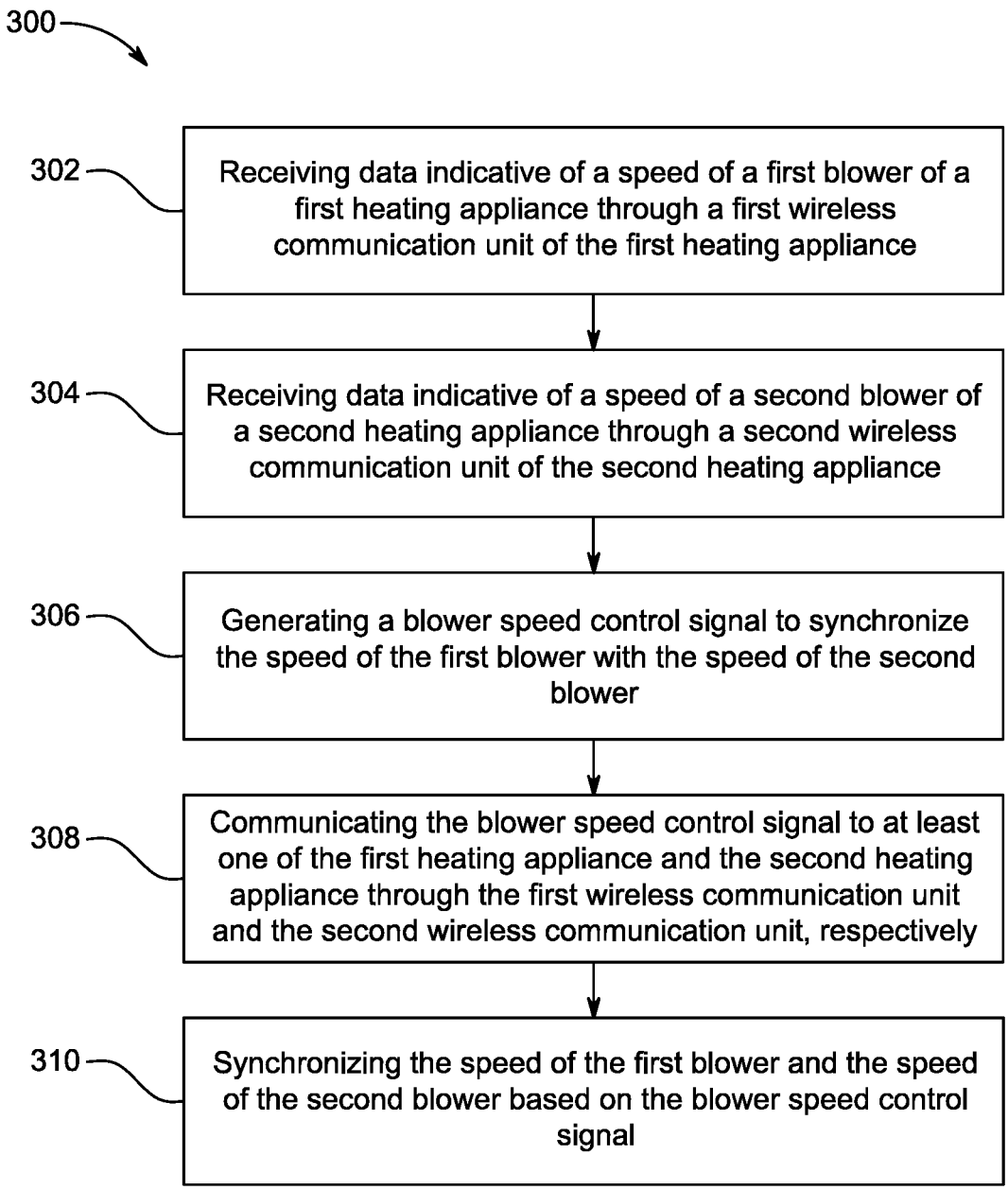
FIG. 3 is a flowchart of a method for controlling heating appliances including the first heating appliance and the second heating appliance twinned together.

FIG. 3 is a flowchart of a method 300 for controlling heating appliances including the first heating appliance 102 and the second heating appliance 104 twinned together. The method 300 is described in conjunction with the FIG. 1A, FIG. 1B, FIG. 2A, and FIG. 2B.

At step 302, the method 300 includes receiving, by the primary control unit 114, data indicative of a speed of the first blower 106 of the first heating appliance 102 through the first wireless communication unit 108 of the first heating appliance 102. In an example, the speed of the first blower 106 may be indicative of an amount of air delivered by the first blower 106, for example, to an enclosed space. In an example, the first wireless communication unit 108 may include a Bluetooth module or any other wireless communication interface. In some embodiments, the primary control unit 114 may be a part of the first heating appliance 102. Accordingly, the primary control unit 114 may receive data indicative of the speed of the first blower 106 of the first heating appliance 102 directly. In some embodiments, the primary control unit 114 may be a part of the second heating appliance 104. Accordingly, the primary control unit 114 may receive data indicative of the speed of the first blower 106 of the first heating appliance 102 through the second wireless communication unit 112.

At step 304, the method 300 includes receiving, by the primary control unit 114, data indicative of a speed of the second blower 110 of the second heating appliance 104 through the second wireless communication unit 112 of the second heating appliance 104. In an example, the speed of the second blower 110 may be indicative of an amount of air delivered by the second blower 110, for example, to the enclosed space. In an example, the second wireless communication unit 112 may include a Bluetooth module or any other wireless communication interface. In some embodiments, the primary control unit 114 may be a part of the second heating appliance 104. Accordingly, the primary control unit 114 may receive data indicative of the speed of the second blower 110 of the second heating appliance 104 directly. In some embodiments, the primary control unit 114 may be a part of the first heating appliance 102. Accordingly, the primary control unit 114 may receive data indicative of the speed of the second blower 110 of the second heating appliance 104 through the first wireless communication unit 108.

At step 306, the method 300 includes generating, by the primary control unit 114, a blower speed control signal to synchronize the speed of the first blower 106 with the speed of the second blower 110. In an implementation, the primary control unit 114 may compare the speed of the first blower 106 with the speed of the second blower 110 of the second heating appliance 104. Responsive to determining the speed of the first blower 106 to be different from the speed of the second blower 110, the primary control unit 114 may generate the blower speed control signal for synchronizing the speed of the first blower 106 with speed of the second blower 110. In an example, the speed of the first blower 106 received by the primary control unit 114 may be 12000 rpm, and the speed of the second blower 110 received by the primary control unit 114 may be 15000 rpm. Different speeds of the first blower 106 and the second blower 110 may indicate that the first blower 106 and the second blower 110 deliver different amounts of air to the enclosed space. This may create an airflow imbalance situation. Since the speeds of both the first blower 106 and the second blower 110 are different, the primary control unit 114 generates the blower speed control signal for synchronizing the speed of the first blower 106 with the speed of the second blower 110.

At step 308, the method 300 includes communicating, by the primary control unit 114, the blower speed control signal to at least one of the first heating appliance 102 and the second heating appliance 104 through the first wireless communication unit 108 and the second wireless communication unit 112, respectively. In an example, the primary control unit 114 may communicate the blower speed control signal to the first heating appliance 102 through the first wireless communication unit 108. In another example, the primary control unit 114 may communicate the blower speed control signal to the second heating appliance 104 through the second wireless communication unit 112. In yet another example, the primary control unit 114 may communicate the blower speed control signal to both the first heating appliance 102 and the second heating appliance 104 through the first wireless communication unit 108 and the second wireless communication unit 112, respectively.

At step 310, the method 300 includes synchronizing, by the primary control unit 114, the speed of the first blower 106 and the speed of the second blower 110 based on the blower speed control signal. By synchronizing the speed of the first blower 106 and the speed of the second blower 110, the first blower 106 and the second blower 110 are set to operate or run at a same speed at a same time such that the first blower 106 and the second blower 110 deliver substantially same amounts of air at the same time.

In an implementation, the first heating appliance 102 (through the first wireless communication unit 106) may receive the blower speed control signal from the primary control unit 114. Upon receiving the blower speed control signal, the first heating appliance 102 may modify the speed of the first blower 106 to synchronize the speed of the first blower 106 with the speed of the second blower 110. In an example, if the speed of the first blower 106 is 12000 rpm and the speed of the second blower 110 is 15000 rpm, then the first heating appliance 102 (or the first blower 106) may increase the speed of the first blower 106 by 3000 rpm such that the speed of the first blower 106 becomes same as the speed of the second blower 110, i.e., 15000 rpm.

In another implementation, the second heating appliance 104 (through the second wireless communication unit 112) may receive the blower speed control signal from the primary control unit 114. Upon receiving the blower speed control signal, the second heating appliance 104 may modify the speed of the second blower 110 to synchronize the speed of the second blower 110 with the speed of the first blower 106. In an example, if the speed of the first blower 106 is 12000 rpm and the speed of the second blower 110 is 15000 rpm, then the second heating appliance 104 (or the second blower 110) may decrease the speed of the second blower 110 by 3000 rpm such that the speed of the second blower 110 becomes same as the speed of the first blower 106, i.e., 12000 rpm.

In yet another implementation, both the first heating appliance 102 (through the first wireless communication unit 106) and the second heating appliance 104 (through the second wireless communication unit 112) may receive the blower speed control signal from the primary control unit 114. In an example, upon receiving the blower speed control signal, the first heating appliance 102 may modify (i.e., either increase or decrease) the speed of the first blower 106, and the second heating appliance 104 may maintain the speed of the second blower 110 to synchronize the speed of the first blower 106 and the speed of the second blower 110. In another example, upon receiving the blower speed control signal, the second heating appliance 104 may modify (i.e., either increase or decrease) the speed of the second blower 110, and the first heating appliance 102 may maintain the speed of the first blower 106 to synchronize the speed of the first blower 106 and the speed of the second blower 110. In yet another example, upon receiving the blower speed control signal, the second heating appliance 104 may modify (i.e., either increase or decrease) the speed of the second blower 110, and the first heating appliance 102 may also modify the speed of the first blower 106 to synchronize the speed of the first blower 106 and the speed of the second blower 110 to a predetermined number. Considering the example, where the speed of the first blower 106 is 12000 rpm and the speed of the second blower 110 is 15000 rpm, then the second heating appliance 104 (or the second blower 110) may decrease the speed of the second blower 110 by 2000 rpm such that the speed of the second blower 110 becomes 13000 rpm and at the same time, the first heating appliance 102 (or the first blower 106) may increase the speed of the first blower 106 by 1000 rpm such that the speed of the first blower 106 becomes 13000 rpm in synchronization with the speed of the second blower 110.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof

What is claimed is:

1. A system for controlling twinned heating appliances, the system comprising:

a first heating appliance comprising a first blower and a first wireless communication unit;

a second heating appliance operatively coupled with the first heating appliance as a twinned unit, the second heating appliance including a second blower and a second wireless communication unit; and a primary control unit disposed at the first heating appliance, the primary control unit configured to:

determine speed data indicative of a speed of the first blower;

determine, using the second wireless communication unit, speed data associated with the second blower;

compare the speed data associated with the first blower with the speed data associated with the second blower;

based on the comparison, determine a blower speed control signal for synchronizing the speed of the first blower and the speed of the second blower; and transmit the blower speed control signal to the second heating appliance, wherein the blower speed control signal overrides a current blower speed of the second blower and causes the second blower to synchronize a speed of the second blower with the speed of the first blower.

2. The system of claim 1, wherein the primary control unit is integrated into the first heating appliance.

3. The system of claim 1, further comprising a secondary control unit, wherein the secondary control unit and the primary control unit are configured to operate together in a primary/secondary configuration.

4. The system of claim 1, wherein the primary control unit is configured to maintain the speed of the first blower and the second blower or modify the speed of the first blower and the second blower.

5. The system of claim 1, wherein each of the first wireless communication unit and the second wireless communication unit includes a wireless module configured to transmit data over a personal area network.

6. The system of claim 1, wherein the first blower of the first heating appliance and the second blower of the second heating appliance include a first motor and a second motor, respectively.

7. The system of claim 6, wherein each of the first motor and the second motor is an electronically commutated motor or brushless DC motor.

8. The system of claim 1, further comprising a common supply duct coupled with the first heating appliance and the second heating appliance, wherein the first blower and the second blower are configured to circulate air to an enclosed space through the common supply duct.

9. The system of claim 3, wherein the secondary control unit is integrated into the second heating appliance.

10. The system of claim 1, wherein the first wireless communication unit is configured to establish a connection to the second wireless communication unit via a personal area network.

11. The system of claim 1, wherein the primary control unit is further configured to receive speed data indicative of the speed of the second blower from the second heating appliance.

12. The system of claim 11, wherein the primary control unit is further configured to determine that the speed of the second blower is different than a speed of the first blower.

13. The system of claim 12, wherein the primary control unit is further configured to transmit the blower speed control signal to the first blower.

14. A method for controlling heating appliances including a first heating appliance and a second heating appliance twinned together, the method comprising:

determining, by a primary control unit disposed at the first heating appliance, data indicative of a speed of a first blower of the first heating appliance;

receiving, by the primary control unit, data indicative of a speed of a second blower of the second heating appliance through a second wireless communication unit of the second heating appliance;

generating, by the primary control unit, a blower speed control signal to synchronize the speed of the second blower with the speed of the first blower;

communicating, by the primary control unit, the blower speed control signal to the second heating appliance through the second wireless communication unit, wherein the blower speed control signal overrides a current blower speed of the second blower; and synchronizing, by the primary control unit, the speed of the first blower and the speed of the second blower based on the blower speed control signal, wherein the synchronizing comprises:

comparing, by the primary control unit, the speed of the first blower of the first heating appliance with the speed of the second blower of the second heating appliance; and responsive to determining the speed of the first blower to be different from the speed of the second blower, generating, by the primary control unit, the blower speed control signal for synchronizing the speed of the first blower and the speed of the second blower.

15. The method of claim 14, wherein the primary control unit is a part of the first heating appliance.

16. The method of claim 14, further comprising:

modifying, by the first heating appliance, the speed of the second blower to synchronize the speed of the second blower with the speed of the first blower.

17. The method of claim 14, further comprising:

receiving, by the second heating appliance through the second wireless communication unit, the blower speed control signal from the primary control unit; and modifying, by the second heating appliance, the speed of the second blower to synchronize with the speed of the second blower with the speed of the first blower.

18. The method of claim 14, wherein each of the first wireless communication unit and the second wireless communication unit includes a wireless module configured to transmit data over a personal area network.

* * * * *